United States Patent [19]

Dierkes

[11] 4,168,871

[45] Sep. 25, 1979

[54] SHOE RACK

[75] Inventor: Erwin Dierkes, Beverungen, Fed. Rep. of Germany

[73] Assignee: Firma Erwin Dierkes Kleinmobelfabrik, Beverungen, Fed. Rep. of Germany

[21] Appl. No.: 888,495

[22] Filed: Mar. 20, 1978

[51] Int. Cl.[2] ..... A47B 88/00; A47F 7/08

[52] U.S. Cl. ..... 312/324; 312/327; 312/313; 211/34

[58] Field of Search ..... 312/324, 327, 313, 271, 312/322; 211/34, 35, 36, 37, 38, 60 SK

[56] References Cited

U.S. PATENT DOCUMENTS

| | | | |
|---|---|---|---|
| 198,056 | 12/1877 | Stein | 312/313 |
| 964,242 | 7/1910 | Greenawalt | 312/271 |
| 1,702,361 | 2/1929 | Olinger | 312/313 |
| 1,920,452 | 8/1933 | Wagner | 312/313 |
| 2,294,504 | 9/1942 | Knape | 211/38 |
| 2,648,583 | 8/1953 | Teach | 312/313 |
| 2,698,689 | 1/1955 | Novack | 211/34 |
| 2,785,036 | 3/1957 | Elsden-King et al. | 312/327 |
| 3,625,371 | 12/1971 | Dill | 312/313 |
| 3,801,279 | 4/1974 | Grieco | 312/271 |

FOREIGN PATENT DOCUMENTS

| | | | |
|---|---|---|---|
| 1172017 | 6/1964 | Fed. Rep. of Germany | 211/37 |
| 653163 | 5/1951 | United Kingdom | 211/37 |
| 677288 | 8/1952 | United Kingdom | 211/37 |

OTHER PUBLICATIONS

Wash. Post, p. 17M 6-24-51.

*Primary Examiner*—Victor N. Sakran

*Attorney, Agent, or Firm*—Schwartz, Jeffery, Schwaab, Mack, Blumenthal & Koch

[57] ABSTRACT

A shoe rack or cabinet is provided with at least one flap door. A first shoe receiving compartment is journalled to pivot within the rack about a horizontal axis. A second shoe receiving compartment is secured to the inside of the flap door and is connected by control levers to pivot with the first shoe receiving compartment secured to the rack.

5 Claims, 3 Drawing Figures

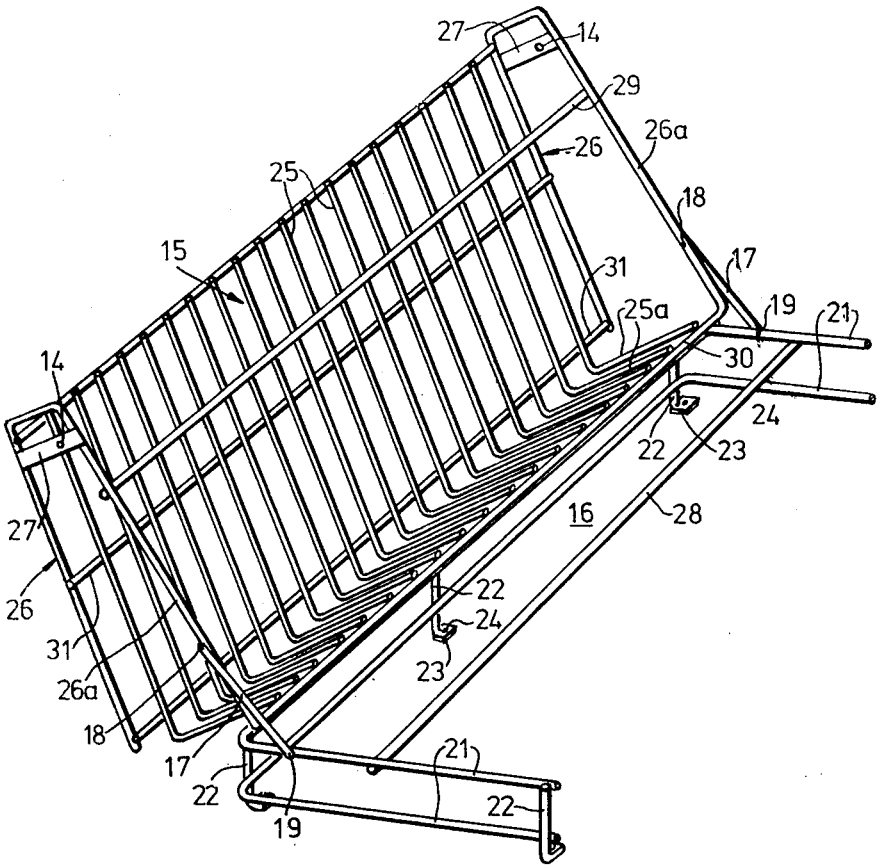
-FIG.1-

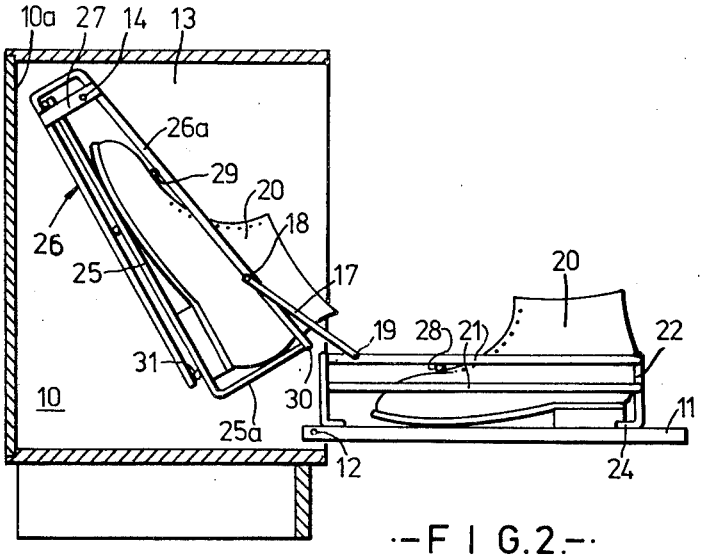
-FIG.2.-
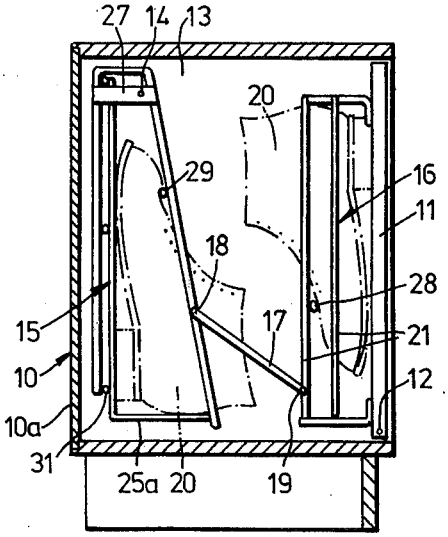
-FIG.3.-

SHOE RACK

BACKGROUND OF THE INVENTION

The present invention concerns a shoe or boot rack which is provided with at least one flap door member and with at least one shoe receiving compartment enabling shoes or boots to be compactly accommodated, as well as permitting easy access for readily removing and charging with said shoes or boots.

The shoe receiving unit is simple and inexpensive to contruct, can be simply secured in and to the shoe rack and, dependent upon the opening and closing movement of the flap door member, brought into the compact storage position and the very easily accessible removal and charging position of the shoes or boots.

SUMMARY OF THE INVENTION

According to the present invention there is provided a shoe rack having at least one flap door, comprising a first shoe receiving compartment journalled to pivot within said rack about a horizontal axis, and a second shoe receiving compartment secured to the inside of said flap door and connected by control levers to pivot with said first shoe receiving compartment secured to said rack.

The shoe rack or cabinet of the present invention is preferably provided with at least one shoe receiving unit which, dependently on the movement of the flap door, can be brought to the space-saving shoe storage position and into a readily accessible shoe feeding and removal position. The shoe receiving unit is preferably composed of two receiving compartments and control levers connecting these two receiving compartments together in movement engagement, one compartment being pivotably suspended within the cabinet and the other compartment being secured to the inside of the flap door.

When the flap is closed, the compartment attached thereto swivels into the cabinet and, by means of the control levers, the compartment within the cabinet is swung back towards the rear wall of the rack, so that, when the flap is closed, both cabinets are vertically arranged within the rack, and one behind the other in the direction of the depth of the rack. Both compartments preferably receive the shoes so that those of one compartment point downwardly with their toes and those of the other compartment with the toes pointing upwardly, thus enabling shoes to be accommodated in an optimally space-saving manner since heel and toe of the shoes are opposed to each other, the free space formed by the toes between the shoes is mutually exploited and this enables the compartments to be closely swung together, and hence a large capacity for receiving shoes is obtained in a small space.

When the flap door is opened, the compartment on the inside of said door swings outwardly and takes with it, by means of the levers, the compartment on the inside of the door, said compartment being brought to an incline directed downwardly at an oblique angle and forwardly so that both compartments are very easily accessible. The compartments receive the shoes with a clamping action by means of a bracing retaining strut—this results in the shoes being reliably secured when being swivelled and also when stored, which may be regarded as the solution of a further problem. Both compartments are simply and economically designed and can be easily mounted in and on the shoe cabinet.

In the case of shoe racks having a plurality of flap doors, a plurality of shoe receiving units may be fitted therein one above the other and/or one behind the other.

BRIEF DESCRIPTION OF THE DRAWINGS

FIG. 1 is a perspective view of two shoe receiving compartments coupled together, and securable in a shoe rack and to a flap of said rack;

FIG. 2 is a vertical cross-section through said shoe rack with said shoe receiving compartments shown in the feeding and receiving position for the shoes or boots; and FIG. 3 is a vertical cross-section through said shoe rack with said shoe receiving compartments shown swung into the said rack in the shoe storage position.

DESCRIPTION OF THE PREFERRED EMBODIMENTS

A shoe rack 10 is provided with at least one flap door member 11 which is preferably mounted to swing downwardly about a horizontal axis or hinge 12 on the front of said rack.

Within the interior 13 of said rack, journalled to pivot about a horizontal axis, is a first shoe receiving compartment 15, and on the inside of the flap door member 11 a second shoe receiving compartment 16 is secured, which is pivotably connected to said compartment 15 by control levers 17 acting as connecting and guide levers.

By its upper end, said compartment 15 is suspended from the top of the interior 13 by two pivot pins 14 so that it can swivel in the interior 13 of the rack towards the flap 11 and towards the rear wall 10*a* of the rack.

The second compartment 16 is mounted on the flap 11 and is provided to pivot into and out of the interior 13 of said rack 10 by said flap 11 about its hinge 12.

The length of the two compartments 15 and 16 extends in the longitudinal direction of the pivots 12 and 14, and said control lever 17 is provided at both longitudinal ends of the compartments 15 and 16, said lever being pivoted at one end on the horizontal pivotal axis 18 of the compartment 15 and by its other end on the pivotal axis 19 of the compartment 16. Each of the two compartments 15 and 16 receives a plurality of shoes 20 which are disposed adjacent to each other in the longitudinal direction of the compartment and point, in the charging and removing position of the compartments 15 and 16, with their toes in the same direction, namely towards the rear wall 10*a* of the rack 10 (See FIG. 2) and in the storage position (FIG. 3) by the pivoting of the compartments 15 and 16, and the closing of the flap door 11, they have their toes in the opposite direction, whilst the shoes 20 arranged in compartment 15 have their toes pointing upwardly and the shoes 20 in compartment 16 are arranged with their toes pointing downwardly, so that the shoes 20 accommodated in both compartments 15 and 16 are opposed to each other in the closed position of the rack with the toes and heels opposed to each other (see chain-dotted lines in FIG. 3).

The receiving compartment 16 is composed, for example, of two superimposed U-shaped frames 21 and a plurality of securing cross bars 22 holding these frames 21 with a clearance one above the other and securing them together on the flap door 11. The U-shaped frames 21 extend with their planes parallel to the flap door 11, approximately over the entire width and length of the flap door 11 and their cross bars are adjacent to the pivot pin 12 so that the sides of the U-frames point towards the outer edge of the flap door 11, which is the upper edge in the closed position of said flap door 11. The securing bars 22 are perpendicular to the plane of the door and are provided at the bottom with angled securing lugs 23 each having a through bore 24 for a securing means, such as a screw. The U-shaped frames 21 and bars 22 are formed of metal and/or plastics material or the like and connected together by welding or the like to form a structural unit.

The receiving compartment 15 is formed by a grid 25 with angled contact members 25*a* at the bottom and two end U-shaped stirrups 26 which are secured by their downwardly extending shanks on the one hand to the grid 25 and on the other hand to the contact member 25*a* angled towards the flap 11.

With a clearance from the upper cross bar of both U-shaped stirrups 26, a clip plate 27 is secured to each of them and in which the horizontal pivot pin 14 engages and thus supports the compartment 15 suspended to swing in the rack 10.

Both U-shaped stirrups 26 and the grid 25 (25*a*) as also the clip plates 27 are likewise made of metal and/or plastics material or the like and connected to said clip plates 27 by welding or the like to form a unit.

In the case of the compartment 16, the inside of the flap 11 forms the mounting surface for the shoes 20 and in the case of the compartment 15 the bearing surface is formed by the grid 25.

In order to now secure the shoes 20 in position in both compartments 15 and 16 and to secure them during the swivelling, each compartment 15 and 16 has a retaining strut 28, 29 which extends over the clamping area of the shoes 20 and over the entire length of the compartments, being secured to the compartments 15 and 16 by welding or the like.

The retaining strut 28 of the compartment 16 is secured to the upper U-shaped frame 21 with a clearance from its cross-piece and extending parallel thereto, and the retaining strut 29 of the compartment 15 is secured to the shank 26*a* of both U-stirrups 26 extending with a clearance from the grid 25 and mounted on the angled part 25*a* of the grid.

The shoes 20 are placed on the opened flap 11 and clamped with their toes under the strut 28 and the shoes 20 in the compartment 15 stand on the grid 25 and rest with their heel portion on the contact member 25*a* and are also clamped with their toes pushed under the strut 29.

Each of the two control levers 17 engages by one end on the axis 18 of the U-shaped stirrup 26 and the pivotal axis 18 extends with a clearance from the contact member 25*a* to the shank 26*a* holding the retaining strut 29.

A transverse strut 30, which may be made integral with the U-stirrups 26, extends along the free ends of the shanks 26*a* and on which the contact member 25*a* is supported.

The grid 25 with angled contact member 25*a* is formed of a plurality of individual rods and cross struts 31 connecting them and securing them to the stirrups 26.

In the closed position of the flap door 11 and hence in the storage portion of the shoes, the compartment 15 is suspended perpendicularly within the interior 13 of the rack and is kept in the suspended position by the pivotal pins 14—in this case the shoes in the compartment 15 are disposed with their toes pointing upwardly.

The compartment 16 also extends perpendicularly in the interior 13 of the rack, since the flap door 11 has been pivoted upwardly into the vertical closed position—in this case the shoes 20 are also perpendicular in the compartment, but with their toes pointing downwardly (FIG. 3).

For removing or introducing shoes 20, the flap door 11 is swung downwardly about its hinge 12, the control levers at the end swinging the compartment 15 into a forwardly and downwardly inclined position about the pivot 14, a feature which is necessarily carried out on the basis of the compartment 16 moving into the at least approximately horizontal position.

The inclined compartment 15 and the horizontal compartment 16 give very easy access to the shoes 20 for removal and introduction.

In this position the pivotal axes 18, 19 and 12 are at the corner points of a triangle and both compartments 15 and 16 are automatically arrested by the control levers 17 and their pivoting towards each other (FIG. 2).

In the swung-in closed position (FIG. 3) the pivotal axes 18, 19, 12 extend at least approximately along a straight line extending at an angle forwardly and downwardly.

Due to the control levers 17, the compartment 15 is swung about its axis 14 towards the rear wall 10*a* of the rack into the vertical suspended position when the flap door 11 is raised.

The shoe receiving unit formed of both compartments 15 and 16 with the control levers 17 may be arranged superimposed and/or adjacent to each other in a shoe rack 10, its own flap door 11 being provided for each receiving unit.

The size of the compartments 15 and 16 may be made as desired. Furthermore, the compartment 16 may also be provided with its own standing surface for the shoes 20, formed by a grid or the like, in which case the inside of the door is not used as a standing surface.

I claim:

1. A shoe rack comprising:

(a) a cabinet having a flap door pivoted thereon for enclosing the cabinet, said flap door being movable from an open substantially horizontal position to a closed substantially vertical position, (b) a first shoe receiving compartment pivotally mounted within said cabinet, (c) a second shoe receiving compartment mounted on said flap door, (d) said first and second compartments being coupled together by a lever means;

(e) said first compartment in said cabinet including means for receiving shoes wherein the toes of the shoes point upwardly, (f) said second compartment on said flap door including means for receiving shoes wherein the toes of the shoes point inwardly toward the interior of the cabinet when the flap door is in the open position and point downwardly when the flap door is in the closed position, and the toes of the shoes in both compartments point inwardly when the flap door is in the open position, (g) said first compartment further including grid means for receiving the soles of the shoes and an angled contact means for receiving the rear upper portion of the shoes, (h) a pair of U-shaped stirrup means attached to said angled contact means , said stirrup means having a clip plate thereon, said clip plate being pivotally connected to said cabinet for pivotally mounting said first compartment in said cabinet, Wherein said stirrups each have a pair of shanks extending downwardly, the free end of one of said shanks being connected to said grid means and the free end of the other of said shanks being connected to a transverse strut, and said angled contact means being supported by said transverse strut, and (j) wherein sand grid and angled contact means are formed by a plurality of rods and cross struts.

2. A shoe rack according to claim 1 wherein said second compartment is formed by a pair of spaced U-shaped frames connected together in spaced relation by a plurality of securing cross bars having a lower end thereof attached to said flap door for securing said second compartment thereto.

3. A shoe rack according to claim 2 wherein said U-shaped frames are in a plane parallel to said flap door and the securing cross bars are substantially perpendicular to the plane of said flap door.

4. A shoe rack according to claim 2 wherein said lever means has one end connected to one of said shanks and the other end connected to a leg of said U-shaped frame.

5. A shoe rack according to claim 1 wherein said lever means includes a pair of pivotal axes, and said flap door has a pivotal axis at the point said flap door is pivotally mounted to said cabinet, said pivotal axes forming a triangle when said flap door is in the open position, and said pivot axes being in a substantially straight line when said flap door is in the closed position.

* * * * *